US005521057A

United States Patent [19]

Merkel et al.

[11] Patent Number: 5,521,057

[45] Date of Patent: May 28, 1996

[54] PHOTOGRAPHIC ELEMENTS COMPRISING 2-PHENYLCARBAMOYL-1-NAPHTHOL IMAGE-MODIFYING COUPLERS YEILDING DYES RESISTANT TO CRYSTALLIZATION AND REDUCTION

[75] Inventors: Paul B. Merkel; Jerrold N. Poslusny; Ronald E. Leone, all of Rochester; David A. Steele, Webster, all of N.Y.

[73] Assignee: Eastman Kodak Company, Rochester, N.Y.

[21] Appl. No.: 99,039

[22] Filed: Jul. 28, 1993

[51] Int. Cl.[6] ..... G03C 7/305

[52] U.S. Cl. ..... 430/543; 430/544; 430/553; 430/955

[58] Field of Search ..... 430/955, 956, 430/957, 958, 543, 544, 553, 561–563, 549

[56] References Cited

U.S. PATENT DOCUMENTS

| | | | |
|---|---|---|---|
| 3,459,552 | 1/1966 | Yoshida et al. | 96/100 |
| 3,488,193 | 1/1970 | Eynde et al. | 96/55 |
| 4,725,530 | 2/1988 | Kobayashi | 430/505 |
| 4,840,884 | 6/1989 | Mooberry et al. | 430/557 |
| 4,857,442 | 8/1989 | Fujita et al. | 430/553 |
| 4,883,746 | 11/1989 | Shimada et al. | 430/504 |
| 4,957,853 | 9/1990 | Kobayashi et al. | 430/384 |
| 4,959,299 | 9/1990 | Sakanoue et al. | 430/957 |
| 5,114,835 | 5/1992 | Sakanoue | 430/393 |

FOREIGN PATENT DOCUMENTS

| | | | |
|---|---|---|---|
| 676750 | 12/1963 | Canada | 96/102 |
| 0348134 | 12/1989 | European Pat. Off. | 430/957 |
| 0193389 | 10/1990 | European Pat. Off. | G03C 7/32 |
| 2454329 | 5/1975 | Germany | G03C 7/32 |
| 62-247363 | 10/1987 | Japan | G03C 7/34 |
| 1111342 | 4/1968 | United Kingdom | G03C 7/34 |

*Primary Examiner*—Lee C. Wright
*Attorney, Agent, or Firm*—Peter C. Cody

[57] ABSTRACT

Photographic elements comprising certain 2-phenylcarbamoyl-1-naphthol image-modifying couplers exhibit proper hue, a resistance to dye crystallization, and a resistance to leuco cyan dye formation. Such couplers can be utilized for their image-modifying effect and can contribute substantially to the overall dye density of an image.

22 Claims, No Drawings

PHOTOGRAPHIC ELEMENTS COMPRISING 2-PHENYLCARBAMOYL-1-NAPHTHOL IMAGE-MODIFYING COUPLERS YEILDING DYES RESISTANT TO CRYSTALLIZATION AND REDUCTION

FIELD OF THE INVENTION

This invention relates; to photographic elements and to novel two-equivalent 2-phenylcarbamoyl-1-naphthol image-modifying couplers.

BACKGROUND

Modern photographic materials, particularly color negative films, contain a variety of so-called image modifying couplers including development inhibitor releasing (DIR) couplers, switched or timed inhibitor releasing (DIAR) couplers, bleach accelerator releasing couplers (BARCs) and colored masking couplers. DIR couplers, such as those described in U.S. Pat. No. 3,227,554, and DIAR couplers, such as those described in U.S. Pat. No. 4,248,962, perform such useful functions as gamma or curve shape control, sharpness enhancement, granularity reduction and color correction. BARCs, such as those described in European Patent Application 193,389, facilitate the oxidation of developed silver in bleach solutions. They may also enhance silver developability, thereby affecting gamma (contrast). Masking couplers, such as those described in J. Opt. Soc. Am, 40, 171 (1950) and in U.S. Pat. No. 2,428,054, are used to correct for the unwanted absorptions of various imaging dyes.

Modern color negative films often contain both image couplers, which contribute solely to the production of dye, and image-modifying couplers, such as those described above. The image-modifying couplers, in addition to having an image modifier component (e.g. bleach accelerator or development inhibitor), also comprise an image dye parent. In films which comprise both image couplers and image-modifying couplers, much of the ultimate color density exhibited by the film is often derived from the parent of the image-modifying coupler.

Many films today contain large amounts of such image-modifying couplers in the red-sensitive, cyan-dye-containing layers. These image-modifying couplers typically have cyan image dye parents which generate cyan dye upon reaction of the image-modifying couplers with oxidized developer. Because such cyan dye substantially contributes to the total red density in these films, it is important that the dyes generated from the image-modifying couplers have suitable properties. Desirable properties include good hue, good stability, resistance to reduction in seasoned bleaches or in bleaches of low oxidizing strength, and resistance to hue changes on storage at low temperatures.

Resistance to reduction in seasoned bleaches is particularly important because certain cyan dyes are prone to being reduced by ferrous ion complexes (such as ferrous EDTA) and other reducing agents, which are found in seasoned bleach solutions. When reduced, these cyan dyes form leuco cyan dyes (LCD formation). Leuco cyan dyes are colorless and, thus, films containing couplers which are easily converted into leuco cyan dyes exhibit substantial loss (and variability) in color density during processing.

Resistance to hue changes upon storage at low temperatures is also of particular importance. Certain cyan dyes tend to crystallize at low temperatures. This naturally affects the hue of such dyes, and it ultimately leads to inaccurate color and tone reproduction in films which have been stored at low temperatures, and which contain these dyes.

From the above, it can be seen that a need exists for image-modifying couplers which are capable of being used in conjunction with image couplers, and which can contribute substantially to the overall color density of an image. Furthermore, a need exists that the dyes generated from such image-modifying couplers be resistant to reduction in seasoned bleaches and be resistant to crystallization at low temperatures.

Certain of the above needs have been provided by known couplers having a 2-phenylcarbamoyl-1-naphthol structure. However, such couplers do not enable all of the above needs to be met. Image couplers, for instance, are known which yield dyes that are resistant to reduction in seasoned bleaches (U.S. Pat. Nos. 3,488,193 and 4,957,853). However, these couplers often crystallize at low temperatures. Furthermore, U.S. Pat. No. 4,957,853 discloses that these couplers should not be combined with photographically useful groups to form image-modifying couplers. Such a combination would impair the photographic properties of a photographic element containing the image-modifying couplers.

Bleach accelerator releasing couplers, development inhibitor releasing couplers (both timed and untimed, switched and unswitched), and masking couplers, having a 2-phenylcarbamoyl-1-naphthol structure, are also known (EP 0193389, Japanese Kokai JP62-247363, U.S. Pat. No. 4,725,530, DES. 2,454,329, British Patent 1,111,342, Japanese Kokai JP62-087959, U.S. Pat. Nos. 3,459,552, and 4,883,746). Several of these image-modifying couplers, however, provide dyes which crystallize at low temperatures. Several others provide dyes which are prone to reduction in seasoned bleach, or which have improper hue; and still others have insufficient or improper image-modifying effect.

As noted, a need exists to provide for image-modifying couplers which are capable of being used in conjunction with image couplers, and which can contribute substantially to the overall color density of an image. Furthermore, a need exists that such image-modifying couplers be resistant to reduction in seasoned bleaches and be resistant to crystallization at low temperatures.

SUMMARY OF THE INVENTION

In this regard, the present invention solves these problems by providing a photographic element comprising a support bearing (a) at least one silver halide emulsion and (b) at least one cyan dye-forming 2-phenylcarbamoyl-1-naphthol image-modifying coupler having the structure

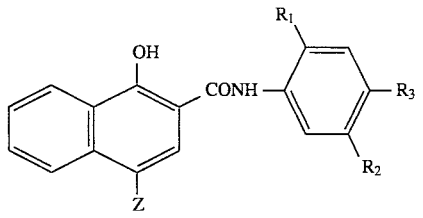

wherein:

$R_1$ is selected from an alkoxy group, a phenoxy group, and halogen;

$R_2$ is selected from the group consisting of an alkyl group, a phenyl group, an alkoxy group, a halogen, and an alkoxycarbonyl group; with the proviso that when $R_2$ is a halogen or alkoxycarbonyl group, $R_1$ is selected from an alkoxy or a phenoxy group;

$R_3$ is selected from hydrogen, and an alkyl group;

$R_1$, $R_2$, and $R_3$ together contain at least 3 carbon atoms; and

Z is a bleach accelerator group.

In one embodiment of the invention, the photographic element comprises a coupler as defined above, but wherein $R_2$ is selected from the group consisting of an alkyl group, a phenyl group; an alkoxy group, and a halogen; with the proviso that when $R_2$ is a halogen, $R_1$ is selected from an alkoxy or a phenoxy group. It is preferred in this embodiment that $R_1$ be selected from an unsubstituted unbranched alkoxy group, and a substituted alkoxy group having less than 6 carbon atoms.

In another embodiment, the photographic element comprises a coupler as defined above, but wherein $R_1$, $R_2$, and $R_3$ together contain at least 9 carbon atoms. In such instances, it is desired that $R_1$ be an unsubstituted unbranched alkoxy group, $R_2$ be an unsubstituted alkyl group, and $R_3$ be hydrogen.

The particular selection of substituents on the phenyl group of the 2-phenylcarbamoyl-1-naphthol image-modifying coupler, as well as the particular placement of the substitutents at ortho and meta positions, has been found to impart surprising characteristics to the photographic elements of the invention. Specifically, photographic elements comprising couplers in accordance with the invention exhibit proper activity, proper hue, a resistance to dye crystallization, and a resistance to leuco cyan dye formation.

DETAILED DESCRIPTION OF THE INVENTION

The present invention concerns image-modifying couplers having the structure defined below, and photographic elements containing such couplers. Specifically, the invention concerns photographic elements comprising a cyan dye-forming 2-phenylcarbamoyl- 1-naphthol image-modifying coupler having the structure I:

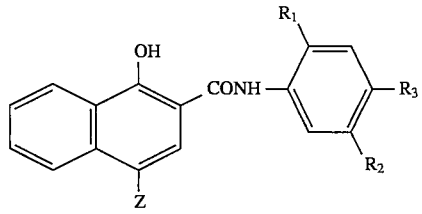

I wherein:

$R_1$ is selected from an alkoxy group (preferably unbranched and unsubstituted), a phenoxy group, and halogen;

$R_2$ is selected from the group consisting of an alkyl group, a phenyl group, an alkoxy group (preferably unbranched and unsubstituted), a halogen, and an alkoxycarbonyl group; with the proviso that when $R_2$ is a halogen or alkoxycarbonyl group, $R_1$ is selected from an alkoxy or a phenoxy group;

$R_3$ is selected from hydrogen, and an alkyl group;

$R_1$, $R_2$, and $R_3$ together contain at least 3 carbon atoms, preferably at least 9 carbon atoms, and optimally between 12 and 30 carbon atoms; and Z is a bleach accelerator group; optionally linked to the remainder of the coupler by means of a timing or switching group. Timing or switching groups as known in the art include those described, for example, in European Patent 0255085, U.S. Pat. Nos. 4,409,323, and 4,248,962.

As used herein, substituents described without reference to branching or substitutions are to be construed as optionally containing branching and/or substitutions.

Also as used herein, alkoxycarbonyl is to be defined as a group having the structure $COOR_5$, wherein $R_5$ is an alkyl group.

In the more preferred embodiments of the invention, the couplers are defined as above (structure I) except that $R_2$ is selected from the group consisting of an alkyl group, a phenyl group, an alkoxy group, and a halogen; with the proviso that when $R_2$ is a halogen, $R_1$ is selected from an alkoxy or a phenoxy group. When either $R_1$ or $R_2$ is an alkoxy group, it is preferred that the group be unsubstituted and unbranched; and in the case of $R_1$, a substituted alkoxy group having less than 6 carbon atoms.

The couplers may also be defined as above, but where $R_1$ is an unsubstituted unbranched alkoxy group, $R_2$ is an unsubstituted alkyl group, and $R_3$ is hydrogen. In such instances, it is even more preferred that $R_1$ be an n-dodecyloxy group and $R_2$ be a methyl group; or that $R_1$ be selected from an n-dodecyloxy group and an n-decyloxy group, and $R_2$ be a secondary butyl group.

Other preferred structures include those where $R_1$ is an unsubstituted, unbranched alkoxy group, $R_2$ is an alkoxycarbonyl group, and $R_3$ is hydrogen. Preferably, $R_1$ is an n-octyloxy group and $R_2$ is a 2-ethylhexoxycarbonyl group.

The photographic elements of this invention comprise specific types of photographically useful groups called bleach accelerator groups. Such bleach accelerator groups preferably are of the structure $$-(TIME)_p-S-L-W$$

wherein:

TIME is a timing or switching group;

p is 0 or 1;

L is a linking group, preferably an alkyl containing from 1 to 8 carbon atoms; and W is a water solubilizing group such as a carboxyl group, a hydroxyl group, or an amino group, (e.g. dimethylamino or morpholino groups). L can be selected from substituted or unsubstituted alkylene and alkylene-O-alkylene groups. Groups substituted on the alkylene and alkylene-O-alkylene groups include alkyl groups, hydroxyl groups, alkoxy groups and amino groups.

Other preferred bleach accelerator groups are of the structure

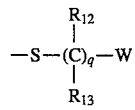

wherein:

q is 1 to 6, preferably 2;

W is a carboxyl group or a hydroxyl group;

and $R_{12}$, $R_{13}$, are individually selected from hydrogen, alkyl groups having 1 to 4 carbon atoms, alkoxy groups having 1 to 4 carbon atoms, and hydroxyl groups; with the proviso that when W is a hydroxyl group, at least one of the $R_{12}$ or $R_{13}$ is a hydroxyl group;

or of the structure

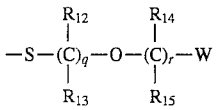

wherein:

q is 1 to 6, preferably 2;

r is 1 to 4, preferably 2;

W is a carboxyl group or a hydroxyl group;

$R_{12}$, $R_{13}$, $R_{14}$ and $R_{15}$ are selected individually from hydrogen, alkyl groups having 1 to 4 carbon atoms, alkoxy groups having 1 to 4 carbon atoms, or hydroxyl groups; with the proviso that when W is a hydroxyl group, at least one of the $R_{12}$ through $R_{15}$ groups is a hydroxyl group.

Ideally, the bleach accelerator group of the present invention is selected from the group consisting of $$-S-CH_2-CH_2-COOH$$

and $$-S-CH_2-CH_2-O-CH_2-CH_2-COOH.$$

Examples of 2-phenylcarbamoyl-1-naphthol BARCs according to this invention include the following:

C1

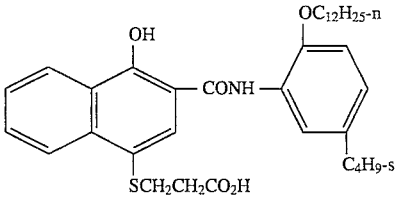

C2

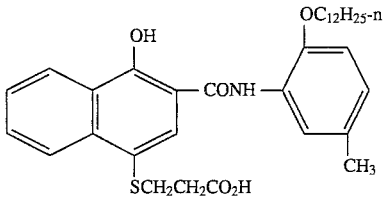

C3

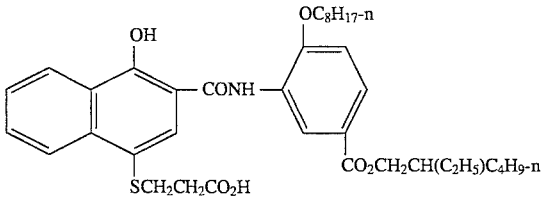

C4

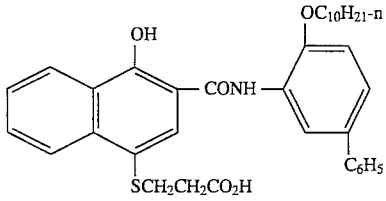

-continued

C5

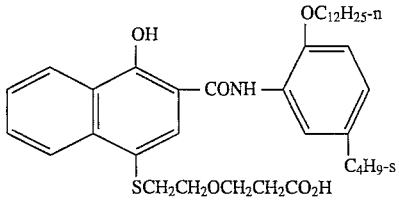

C6

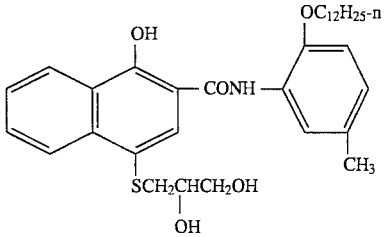

C7

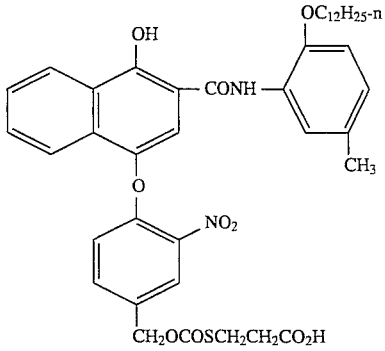

C8

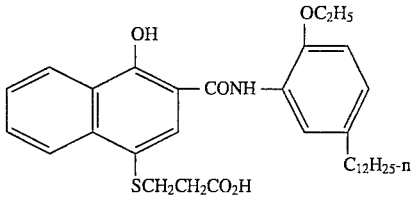

Most preferred are selected from the group consisting of

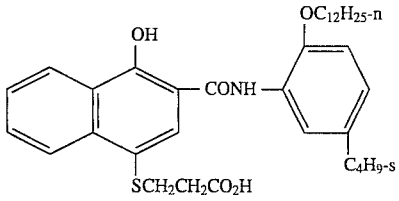

and

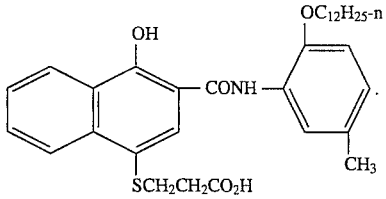

The photographic elements of the present invention can contain broad ranges of the above-described image-modifying couplers. Preferably, the image-modifying couplers are present in amounts between about 0.002 and about 0.40 grams per square meter. Ideally, they are present in amounts between about 0.01 and about 0.20 grams per square meter.

The BARCs of this invention may be used in combination with yellow or magenta image couplers or image-modifying couplers. It is desired, though, that the 2-phenylcarbamoyl-1-naphthol image-modifying couplers of this invention be used with cyan image couplers, including those of structures below:

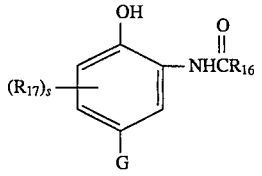

II

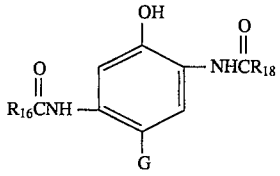

III

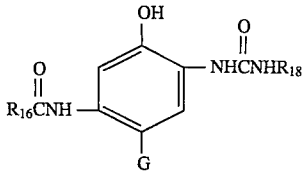

IV

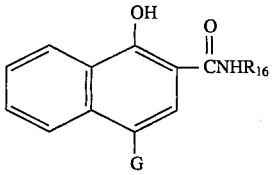

V wherein:

s is from 0 to 3;

$R_{16}$ is a ballast group, such as an unsubstituted or a substituted alkyl group with at least 10 carbon atoms, or a substituted phenyl group with at least 10 carbon atoms;

each $R_{17}$ is individually selected from halogens, alkyl groups of 1 to 4 carbon atoms and alkoxy groups of 1 to 4 carbon atoms;

$R_{18}$ is selected from unsubstituted or substituted alkyl groups, and unsubstituted or substituted aryl groups, wherein the substituents comprise one or more electron-withdrawing groups or atoms, such as cyano, chloro, fluoro, methylsulfonyl, or trifluoromethyl; and G is hydrogen or a coupling-off group that is not photographically useful. Examples of G include chlorine, an alkoxy group, an aryloxy group, a ballasted alkylthio or arylthio group, an acyloxy group, a carbonamido group, a sulfonamido group, and a nitrogen-containing heterocyclic group, such as a pyrazolyl, an imidazolyl, a succinimido or an hydantoinyl group.

Preferred image couplers for use in combination with the 2-phenylcarbamoyl-1-naphthol image-modifying couplers of this invention are the 2-phenylureido- 5-carbonamidophenol cyan dye-forming couplers of structure IV, and preferably those in which $R_{18}$ is a p-cyanophenyl group and G is hydrogen or an aryloxy group. Useful weight ratios of the 2-phenylcarbamoyl- 1-naphthol image-modifying couplers of this invention to image coupler are from about 0.005:1.0 to about 2.0:1.0, depending on the layer and the type of image-modifying coupler.

Specific image couplers which may be utilized in the photographic element of the present invention include:

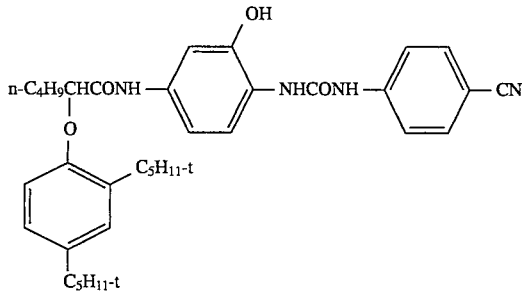

B1

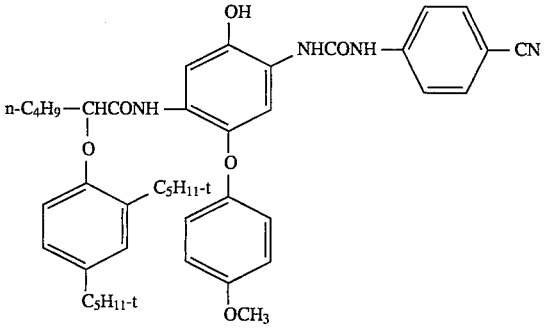

B2

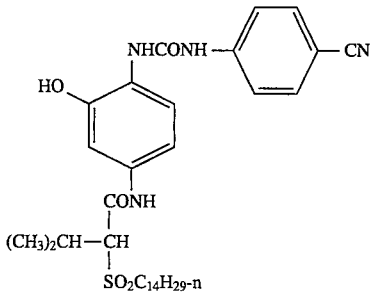

B3

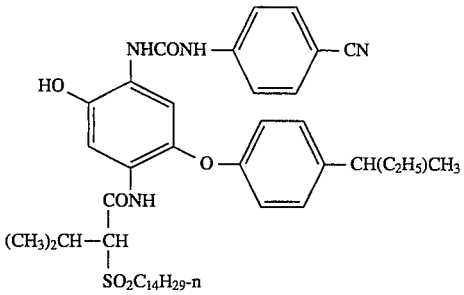

B4

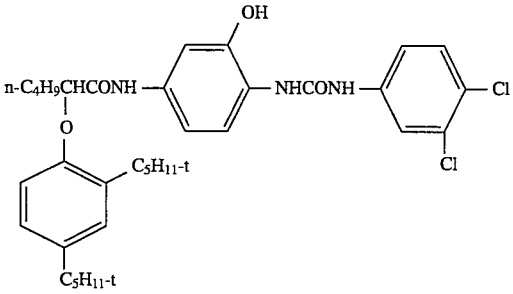

B5

-continued

B6

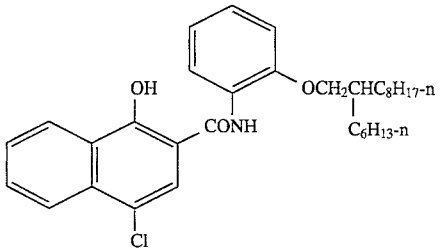

B7

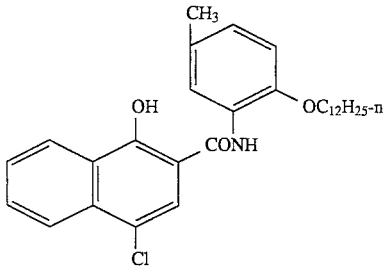

B8

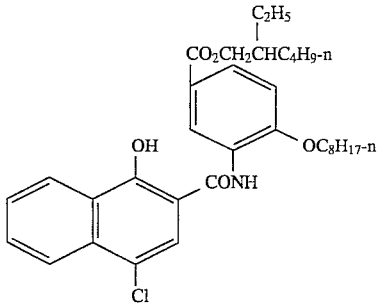

B9

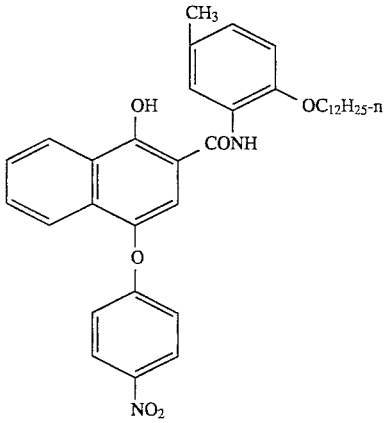

B10

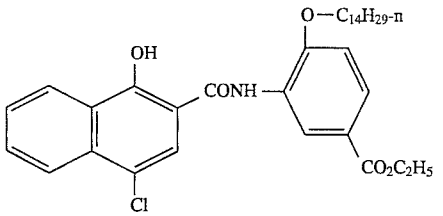

The image-modifying couplers of this invention can be utilized by dissolving them in high-boiling-temperature coupler solvents and then dispersing the organic coupler plus coupler solvent mixture as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate), esters of aliphatic acids (e.g. dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in *Research Disclosure*, December 1989, Item 308119, p 993. Useful coupler:coupler solvent weight ratios range from about 1:0.1 to about 1:10, with about 1:0.2 to about 1:5.0 being preferred.

The photographic image-modifying couplers of the present invention may be employed in photographic materials in a manner well known in the photographic art. For example, a supporting substrate may be coated with a silver halide emulsion comprising a 2-phenylcarbamoyl- 1-naphthol BARC of the present invention. The 2-phenylcarbamoyl-1-naphthol image-modifying couplers may be coated with an image coupler, such as a 2-phenylureido-5-carbonamidophenol image coupler, imagewise exposed, and then developed in a solution containing a primary aromatic amine color developing agent.

The photographic elements of the present invention may be simple elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The element may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure*, December 1978, Item 17643, and December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereinafter by the term "Research Disclosure." A reference to a particular section in "Research Disclosure" corresponds to the appropriate section in each of the above-identified *Research Disclosures*. The elements of the invention can comprise emulsions and addenda described in these publications and publications referenced in these publications.

The silver halide emulsions employed in the elements of this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*, Item 308119, cited above, Section IV.

Suitable vehicles for the emulsion layer and other layers of elements of this invention are described in *Research Disclosure*, Item 308119, Section IX and the publications cited therein.

Besides the 2-phenylcarbamoyl-1-naphthol BARCs described herein, the elements of this invention can include additional couplers as described in Research Disclosure, Section VII, paragraphs D, E, F, and G and the publications cited therein. The additional couplers can be incorporated as described in Research Disclosure, Section VII, paragraph C, and the publications cited therein.

The photographic elements of this invention can contain brighteners (*Research Disclosure*, Section V), antifoggants and stabilizers (*Research Disclosure*, Section VI), antistain agents and image dye stabilizers (*Research Disclosure*, Section VII, paragraphs I and J), light absorbing and scattering materials (*Research Disclosure*, Section VIII), hardeners (*Research Disclosure*, Section X), coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements of the invention can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamido-ethyl)-aniline sulfate hydrate, 4-amino-3-methyl-N-ethyl-N-(β-hydroxyethyl)-aniline sulfate, 4-amino-3-β-(methanesulfonamidoethyl)-N,N-diethylaniline hydrochloride, and 4-amino-N-ethyl-N-(β-methoxyethyl)-m-toluidine di-p-toluenesulfonic acid.

With negative-working silver halide, the processing step described above provides a negative image. The described elements are preferably processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not from dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

Preparation of the 2-phenylcarbamoyl-1-naphthol couplers of this invention is illustrated by the following synthetic example.

Synthesis Example A: Synthesis of the inventive BARC coupler C1 is shown schematically below and described in detail in the subsequent paragraphs.

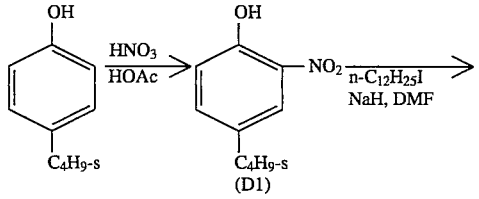

-continued

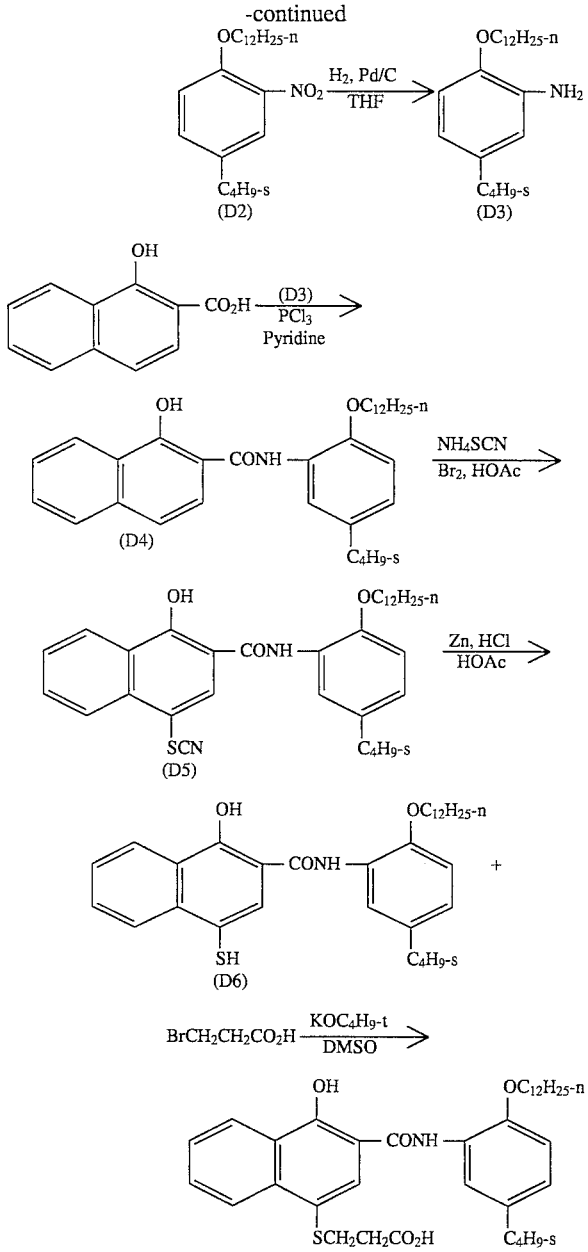

Compound (D1): A solution of 100 g (0.67 mol) of 4-sec-butylphenol in 600 mL of glacial acetic acid was cooled to 15° C. on an ice bath. Red fuming nitric acid (53.5 g, 0.85 mole) was then added dropwise at a rate sufficient to keep the reaction temperature under 17° C. Thin layer chromatography of the product showed one major spot. The reaction mixture was poured into 3L of ice water, and then the aqueous mixture was extracted with 1.5L of ethyl acetate. The extract was dried over magnesium sulfate, filtered and concentrated on a rotary evaporator. The crude product was dissolved in ligroin and chromatographed on silica gel using ligroin as an eluant. On evaporation of the ligroin, 105.0 g of (D1) was obtained as a yellow oil (80% yield).

Compound (D2): Compound (D1) (105.0 g, 0.54 mol) was added to a solution of 200 mL (0.80 mol) of 1-iodododecane and 500 mL of N,N-dimethylformamide. The solution was stirred at room temperature, and 22.0 g (0.54 mol) of 60% sodium hydride was slowly added. Then the mixture was heated at 75° C. for four hours. After cooling to ambient, temperature the mixture was poured into a cold solution of dilute hydrochloric acid and then extracted with 1.4L of ethyl acetate. The extract was dried over magnesium sulfate and filtered. The filtrate was concentrated to give 100 g of crude product, which was dissolved in ligroin and chromotographed on silica gel using ligroin and then a 95:5 mixture of ligroin:ethyl acetate as the eluants. On evaporation of the solvents, 58.0 g of (D2) was obtained as an oil (30% yield).

Compound (D3): Compound (D2) was dissolved in tetrahydrofuran and a catalytic amount of palladium on charcoal was added. The mixture was shaken under a hydrogen atmosphere (3 atm) overnight. The catalyst was removed by filtration and then the solvent was removed under vacuum. This gave 41.0 g of (D3) as a pale yellow oil (82% yield).

Compound (D4): Compound (D3) (41.0 g, 0.12 mol) was dissolved in 250 mL of pyridine and cooled in an ice/acetone bath. Phosphorous trichloride (8.4 g, 0.06 mol) was then added dropwise with stirring. Then 22.6 g (0.12 mol) of 1-hydroxy-2-naphthoic acid in 100 ml of pyridine was added to the cold reaction mixture with stirring. The mixture was then heated to 55° C. for six hours, cooled and poured into dilute hydrochloric acid. The aqueous mixture was then extracted into ethyl acetate, and the extracts were dried over magnesium sulfate and filtered. The solution was concentrated and the residue was dissolved in a small amount of toluene. The solution was chromatographed on silica gel using ligroin/ethyl acetate (95:5) as the eluant. The oil obtained on evaporation of the eluant was dissolved in ligroin. On immersion in an ice/acetone bath, crystals of (D4) formed (MP=56°–58° C.), which were collected by filtration. The yield was 32.8 g or 54%.

Compound (D5): Ammonium thiocyanate (7.6 g, 0.10 mol) was dissolved in 150 mL of glacial acetic acid at room temperature. A solution of 8.0 g (0.050 mol) of bromine in 50 mL of glacial acetic acid was added dropwise over 20 min with good stirring, and then stirred an additional 10 min. (A small amount of yellow solid separated out of solution.) Compound (D4)(25.2 g 0.050 mol) was then added and the reaction mixture was stirred for three hours at room temperature. The mixture was then poured into 1L of ice and water while stirring. A gummy mass formed that solidified on stirring. The solid was collected by filtration, washed with water and partially dried by suction. The material was then dried by dissolving in 900 mL of ethyl acetate containing magnesium sulfate. After filtration, the solvent was removed from the filtrate. The solid obtained was then recrystallized from 100 mL of ligroin to give 15.6 g (56% yield) of (D5)(MP=64°–67° C.), whose structure was confirmed by NMR spectroscopy.

Compound (D6): Compound (D5) (40.0 g, 0.071 mol) was mixed with 1L of glacial acetic acid and 50 mL of concentrated hydrochloric acid, and the mixture was stirred at 80° C. Zinc dust (92.3 g, 1.42 mol) was then added in portions over 30 min. The mixture foamed and the pot temperature rose to 91° C. After stirring for two hours at 80° C., the hot mixture was filtered. The filter cake was washed with 200 mL of hot acetic acid. The warm filtrate was then poured into 2L of ice and water while stirring. The aqueous mixture was extracted twice with ethyl acetate (2L total). A solid formed in the ethyl acetate layer. The ethyl acetate layer was then collected and filtered. The solid obtained was was dried overnight in a vacuum oven under nitrogen and over phosphorous pentoxide at room temperature. This gave 31.5 g (83% yield) of (D6) as a pale yellow powder (MP=58°–60° C.).

Compound C1: 7.8 g (0.070 mol) of potassium-t-butoxide was added to a stirred solution of 34.0 g (0.064 mol) of (D6)

in 250 mL of dimethyl sulfoxide. Then a solution of 9.2 g (0.060 mol) of 3-bromopropionic acid in 60 mL of dimethyl sulfoxide was added dropwise over 30 min, and the solution was stirred an additional two hours. The reaction mixture was then poured into a mixture of 100 mL of concentrated hydrochloric acid in 1L of ice and water while stirring. The aqueous mixture, containing some gummy product, was extracted three times with ethyl acetate. The combined extracts were washed three times with a saturated salt solution, dried over magnesium sulfate and then filtered. The solvent was removed from the filtrate on a rotary evaporator. The yellow oil obtained was chromatographed on silica gel using 98:2 dichloromethane:methanol as the eluant. This gave 21.0 g (58% yield) of a cream colored solid (MP= 92°–95° C.), whose structure was confirmed by NMR spectroscopy and by elemental analysis.

EXAMPLES

In the following examples, coupler solvent S1 refers to tritolyl phosphate (mixed isomers), coupler solvent S2 is dibutyl phthalate, coupler solvent S3 is 1,4-cyclohexylenedimethylene bis(2-ethylhexanoate), coupler solvent S4 is N,N-diethyldodecanamide, coupler solvent S5 is N-butylacetanilide and coupler solvent S6 is N,N-dibutyldodecanamide.

Example 1

Illustration of the Advantageous Properties of the Image-Modifying Couplers of this Invention in a Simplified Test Format.

In order to rapidly evaluate the 2-phenylcarbamoyl-1-naphthol image-modifying couplers of this invention, simple testing procedures were developed for initial comparisons. For these tests, each image-modifying coupler or, in some cases, a four-equivalent parent coupler was coated on a transparent acetate support as a single layer in a gelatin binder. The hardened films were then immersed in a solution containing 4-amino-3-methyl-N-ethyl-N-(β-hydroxyethyl)aniline sulfate and potassium ferricyanide buffered at a pH of 10. The ferricyanide oxidized the developer, which then reacted with the coupler to form dye. The dye absorption spectrum was then measured on a spectrophotometer. Samples were stored at low temperatures and spectra were remeasured to determine the extent of dye crystallization. The extent of reduction to leuco cyan dye (LCD formation) in a simulated seasoned bleach was also determined for the film samples using the procedures described below. In certain cases, the testing procedures were carried out on coatings of the corresponding four-equivalent parent coupler.

The specific dispersion preparation and coating procedures used for the BARCs are illustrated below. An oil phase consisting of 0.06 g of the BARC, 0.06 g of the coupler solvent S1, and 1.6 mL of ethyl acetate auxiliary solvent, was dispersed in an aqueous phase containing 20.2 mL of water, 1.0 g of gelatin, and 0.1 g of the sodium salt of triisopropylnaphthylenesulfonic acid (a surfactant) by passing the mixture through a colloid mill in a manner known in the art. Formaldehyde (0.008 g) was added to the dispersion which was then coated on a cellulose acetate support. The aim BARC laydown was 0.27 g/sq m and the aim gelatin laydown was 4.5 g/sq m. The ethyl acetate evaporated upon coating.

To convert the couplers to dye, the hardened films were immersed for two minutes in a pH=10 borate buffer solution containing 2.0 g/L of 4-amino-3-methyl-N-ethyl-N-(β-hydroxyethyl)-aniline sulfate, 0.25 g/L of sodium sulfate, and 12.0 g/L of potassium ferricyanide. This simulated the chromogenic development in photographic materials. The dye-containing films were then immersed in a 2% acetic acid solution for one minute and then washed for five minutes at 27° C. After the films were dry, the spectra were measured. The spectral absorption maxima (lambda max values) are reported in the tables below. Most film samples had a density of approximately 1.5 at the absorption maximum near 700 nm.

To evaluate the propensity for dye crystallization on cold storage, samples were placed in a freezer at −18° C. for 48 hr. The absorption spectra were then remeasured on a spectrophotometer. The density loss percentages at the absorption maxima due to dye crystallization are listed in the tables below.

To probe the propensity for reduction of cyan dye to the leuco form in seasoned bleaches (LCD formation), or in bleaches of weak oxidizing strength, a test was designed to simulate the bleaching step of a photographic process, such as the C-41 process. After recording the absorption spectra, the dye-containing films were placed for three minutes in a solution consisting of 50 mL of water, 50 mL of fresh Bleach II used in the C-41 process, 2.0 g of ferrous sulfate heptahydrate, 2.5 g of the dipotassium salt of (ethylenedinitrilo)-tetraacetic acid (EDTA) and 1.5 mL of ammonium hydroxide reagent. The pH of the solution was adjusted to 4.75 with acetic acid prior to immersion of the film samples. This procedure simulated the early stag&s of the C-41 bleach process, in which ferrous ion concentrations are quite high due to reduction of iron EDTA upon oxidation of developed silver. The film samples were then placed for four minutes in a solution consisting of 100 mL of fresh C- 41 Bleach II, 1.0 g/L of ferrous sulfate heptahydrate and 0.2 g/L of dipotassium EDTA adjusted to a pH of 4.75. This simulated the ferrous ion levels and acidity of seasoned bleaches actually observed in seasoned processing solutions encountered in trade laboratories. The films were then washed and dried, and their spectra were remeasured. The percentage losses in density at lambda max due to leuco cyan dye formation are also listed in the tables below. Initial densities were approximately 1.5.

Test data for example 2-phenylcarbamoyl-1-naphthol BARCs of this invention and for comparative BARCs are provided in Table IA. Structures of the comparative BARCs E1 through E4 are given below (E4 is used in Example 2).

E1

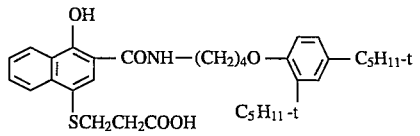

E2

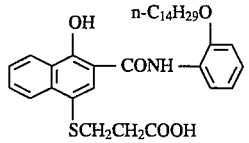

E3

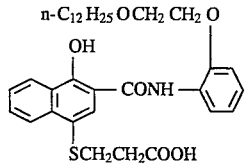

-continued

E4

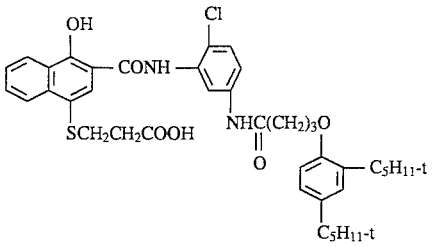

TABLE IA

| Coupler | Coupler Solvent | Weight Ratio[1] | Lambda Max (nm)[2] | Density Loss % at Lambda Max 48 hr @ −18° C.[3] | Density Loss % in Simulated Seasoned Bleach[4] (LCD Test) |
|---|---|---|---|---|---|
| 1 E1 | S1 | 1:1 | 691 | 0.0 | 14.8 |
| 2 E2 | S1 | 1:1 | 699 | 25.3 | 0.0 |
| 3 E3 | S1 | 1:1 | 697 | 2.3 | 0.8 |
| 3 E3 | S2 | 1:1 | 699 | 14.7 | 3.8 |
| 4 C1 | S1 | 1:1 | 698 | 0.0 | 0.0 |
| 5 C1 | S2 | 1:1 | 697 | 0.0 | 3.1 |
| 6 C2 | S1 | 1:1 | 696 | 0.0 | 0.3 |
| 7 C5 | S1 | 1:1 | 698 | 0.0 | 1.0 |

[1]Coupler to coupler solvent weight ratio
[2]Spectral absorbtion maxima
[3]Density loss percentages at the absorption maxima due to dye crystallization
[4]Density loss percentages at the absorption maxima due to leuco cyan dye formation From the data in Table IA, it is evident that all of the comparative BARCs E1 through E3 yield dyes which undergo either a large loss in red density on cold storage (due to crystallization), or a large loss in red density in a simulated seasoned bleach (due to leuco cyan dye formation), or both.

For example, the dye derived from the comparative 2-alkylcarbamoyl-1-naphthol coupler E1 shows a particularly large loss (14.8%) in red density in the simulated seasoned bleach LCD test. The comparative 2-phenylcarbamoyl-1-naphthol coupler E2, by contrast, yields a dye that shows little loss in red density in the LCD test. However, this dye shows a 25.3% loss in red density upon cold storage. Data for the E3 indicates that it too exhibits substantial loss in density due to crystallization and leuco cyan dye formation.

In marked contrast to the comparative couplers, the couplers of this invention, C1, C2, and C5, all yield dyes that show almost no density loss on cold storage and less than 3.1% density loss in the LCD test, regardless of the type of coupler solvent used. C1, for example, shows no density loss due to crystallization or leuco cyan dye formation in coupler solvent S1. In coupler solvent S2, it shows no density loss due to crystallization and only 3.1 percent loss due to leuco cyan dye formation.

The couplers of this invention also yield dyes which exhibit a proper hue; they yield dyes with lambda values at, or near, 700 nm. Couplers which yield dyes with lambda max values significantly above or below 700 nm are less desirable for optimum printing characteristics in color negative materials because a typical color paper onto which a negative is printed has a maximum sensitivity in the region of about 700 nm. Dyes that have an absorption maximum between about 703 nm and 709 nm, though effective, do not modulate light as efficiently in the region of maximum paper sensitivity as dyes which have absorption maxima closer to 700 nm. Dyes that have an absorption maximum above about 709 nm are particularly inefficient and are thus less preferred.

Table IB provides comparative data for a variety of types of four-equivalent 2-phenylcarbamoyl-1-naphthol couplers to illustrate the shortcomings of dyes derived from parent structures that are outside the scope of the claimed invention. Only coupler F8 has the substituents, and locations thereof, to place it (with a bleach accelerator group) and the dye it yields within the scope of invention; and only F8 yields a dye with proper hue, and suitable resistance to crystallization and leuco dye formation. The structures of couplers F1 through F14 are given below.

F1

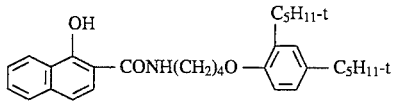

F2

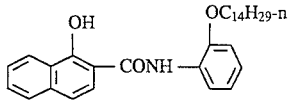

F3

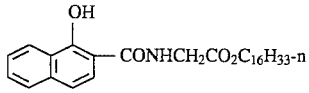

F4

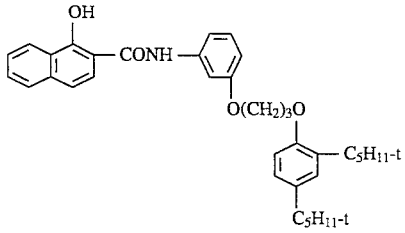

F5

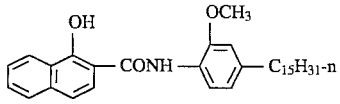

F6

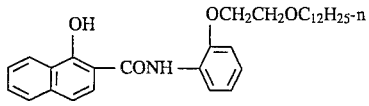

F7

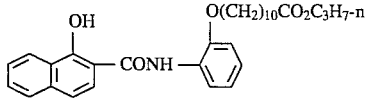

F8

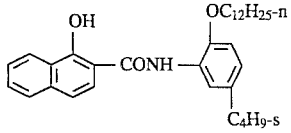

F9

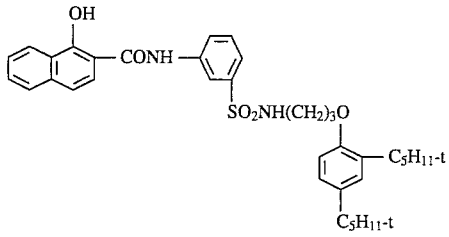

-continued

F10

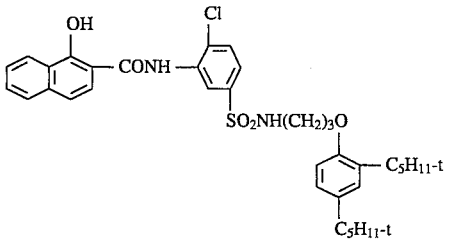

F11

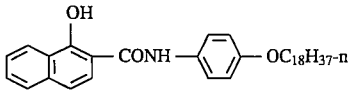

F12

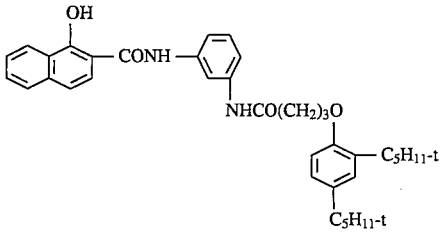

F13

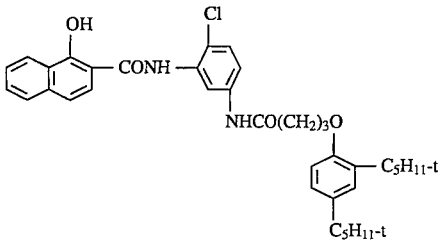

F14

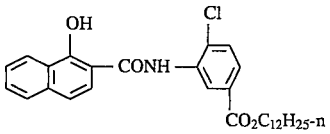

TABLE IB

| Coupler | Coupler Solvent | Weight Ratio[1] | Lambda Max (nm)[2] | Density Loss % at Lambda Max 48 hr @ −18° C.[3] | Density Loss % in Simulated Seasoned Bleach[4] (LCD Test) |
|---|---|---|---|---|---|
| 1 F1 | S1 | 1:2 | 693 | 0.0 | 17.2 |
| 2 F2 | S1 | 1:2 | 700 | 81.4 | 5.3* |
| 3 F3 | S1 | 1:2 | 694 | 1.2 | 15.7 |
| 4 F4 | S1 | 1:2 | 710 | 0.3 | 6.0 |
| 5 F5 | S1 | 1:2 | 700 | 16.4 | 2.6 |
| 6 F6 | S2 | 1:2 | 698 | 82.1 | 2.2 |
| 7 F7 | S1 | 1:2 | 702 | 54.6 | 1.6 |
| 8 F8 | S1 | 1:2 | 701 | 0.0 | 1.4 |
| 9 F8 | S2 | 1:2 | 698 | 0.0 | 2.3 |
| 10 F8 | S6 | 1:4 | 697 | 0.0 | 3.1 |
| 11 F9 | S1 | 1:2 | 720 | 0.0 | 7.4 |
| 12 F10 | S1 | 1:2 | 724 | 28.9 | 1.3 |
| 13 F11 | S6 | 1:4 | 704 | 54.2 | 10.9 |
| 14 F12 | S1 | 1:2 | 710 | 1.1 | 7.6 |
| 15 F13 | S1 | 1:2 | 711 | 0.1 | 1.1 |
| 16 F14 | S1 | 1:2 | 715 | 0.8 | 0.8 |

[1]Coupler to coupler solvent weight ratio
[2]Spectral absorbtion maxima
[3]Density loss percentages at the absorption maxima due to dye crystallization
[4]Density loss percentages at the absorption maxima due to leuco cyan dye formation
*Dye crystallization during the LCD test procedure contributes to the red density losses for this film.

According to the data in Table IB couplers F2, F5, F6, F7, F10 and F11 all yield dyes that show substantial density losses at lambda max due to dye crystallization on cold storage, Couplers F1, F3, F4, F9, F11 and F12 all yield dyes that show substantial (greater than 5%) density losses at lambda max in the simulated seasoned bleach LCD test. Couplers F4, F9, F10,F12, and F13 also yield dyes with hues that are too bathochromic (lambda max greater than 709 nm) in S1. Only coupler F8, which is a four-equivalent analog (absent a bleach accelerator moiety) of the image-modifying couplers of this invention, yields a dye that has the proper hue (701 nm in S1), and that is resistant to crystallization on cold storage and to reduction in a seasoned bleach.

Example 2

Evaluation of the 2-Phenylcarbamoyl-1-Naphthol Image-Modifying Couplers of this Invention in a Photographic Element.

The coating format in the diagram below was used for evaluation of the BARCs of this invention in a photographic element. Construction of the element was done by conventional methods known in the art, wherein BARCs were coated at 0.861 mmol/sq m together with 0,646 g/sq m of silver as a 0.5 micrometer tabular grain silver iodobromide (6%I) emulsion.

2.69 g/sq m Gelatin (Overcoat)
0.129 g/sq m Bis(vinylsulfonylmethyl) Ether Hardener
3.77 g/sq m Gelatin
0.861 mmol/sq m BARC (eg. 0.50 g/sq m E1)
Coupler Solvent @ 1:2 or 1:4 Coupler:Solvent by Weight
0.646 g/sq m Silver as a Silver Iodobromide (6%I) Emulsion
Cellulose Acetate Butyrate Support After hardening, the films were exposed through a step tablet on a 1B sensitometer and then subjected to a KODAK FLEXICOLOR™ C-41 process as described in more detail below. To evaluate the propensity for leuco cyan dye formation in a seasoned bleach, 35 mm film strips were exposed and slit in half. Both halves were then processed at the same time in C-41 developer, and placed in a stop bath to eliminate any variability due to continued coupling. Then, one half was processed in fresh C-41 Bleach II and the other half was processed in a simulated seasoned bleach (Bleach B). Bleach B consisted of fresh Bleach II to which was added 10.0 g/L of ferrous sulfate heptahydrate and 2.0 g/L of dipotassium EDTA dihydrate with the the bleach p H adjusted to 4.75. During processing in Bleach B, agitation was provided by nitrogen bubbling (as opposed to air bubbling for Bleach II) to minimize air oxidation of ferrous ion to ferric ion. Status M red densities(Dr) were measured versus exposure for the samples processed in fresh Bleach II and in simulated seasoned Bleach B. Status M red densities (Dr) were also measured for a set of processed film samples before and after cold storage for 48 hr at −18° C. Density losses were determined from an initial density of 1.0. Absorption spectra were measured for the processed films at a status M red density of about 1.2 on a spectrophotometer. Test results are summarized in Table II.

C-41 PROCESSING SOLUTIONS AND CONDITIONS

| Solution | Processing Time | Agitation Gas |
|---|---|---|
| C-41 Developer | 3' 15" | Nitrogen |
| Stop Bath | 30" | Nitrogen |
| A) Fresh Bleach II | 3' | Air |
| or B) Seasoned Bleach B | 3' | Nitrogen |
| Wash | 1' | None |
| C-41 Fix | 4' | Nitrogen |
| Wash | 4' | None |
| PHOTO-FLO ™ | 30" | None |
| Processing Temperature | | 100° F. |

TABLE II

| Coupler | Coupler Solvent | Weight Ratio[1] | Lambda Max (nm)[2] | Dr Loss % (Status M) in 48 hr @ −18° C.[3] | Dr (Bleach B) - Dr (Bleach II) at Dr = 1.0*[4] |
|---|---|---|---|---|---|
| 1 E1 | S1 | 1:2 | 696 | 0.0 | −0.21 |
| 2 E2 | S1 | 1:2 | 699 | 31.1 | −0.01 |
| 3 E3 | S1 | 1:2 | 699 | 10.0 | −0.10 |
| 4 E4 | S1 | 1:2 | 708 | 0.0 | −0.06 |
| 5 C1 | S1 | 1:2 | 699 | 0.0 | −0.06 |
| 6 C2 | S1 | 1:2 | 698 | 0.0 | −0.07 |

[1]Coupler to coupler solvent weight ratio
[2]Spectral absorbtion maxima
[3]Red density loss percentages due to dye crystallization.
[4]Red density loss due to the leuco cyan dye formation
*Difference represent averages of two runs.

As is illustrated by the data in Table II, only the couplers of this invention yield dyes that have suitable hue, that do not lose red density on cold storage and that undergo minimal loss of red density in a seasoned bleach solution. All of the comparative couplers yield dyes with at least one deficiency. Films with comparative couplers E2, and E3 show severe red density losses after 48 hr at −18° C. due to dye crystallization; the film containing E1 is prone to leuco cyan dye formation; and tile film containing E4 contains a dye which is undesirably bathochromic (relative to C1 and C2).

The inventive C1 and C2 containing films show no such red density losses due to cold storage and leuco cyan dye formation. Further, their lambda max values are close to the desired 700 nm.

Example 3

Use of 2-Phenylcarbamoyl-1-Naphthol BARCs of this Invention in a Multilayer Film.

The multilayer film structures utilized for this comparison are shown below. Gelatin was used as the binder in the various layers: of these films. Dispersions of the various components were prepared and coated by methods known in the art. Component laydowns in g/sq m are listed in parentheses. In the coating diagram, single lines mark the boundaries between layers, and double lines differentiate between separate coating melts in the same layer that are mixed prior to coating. The films were exposed, processed and analyzed similarly to the films in Example 2. Chemical structures of components coated in Examples 3 and 4 that are not previously described in this application are given after the coating diagram of Example 3.

Multilayer Film Structure for Example 3

-continued

Overcoat Layer
Fast Yellow Layer Containing a Yellow Imaging Coupler and Silver Halide Emulsions
Slow Yellow Layer Containing a Yellow Imaging Coupler, a Yellow DIR Coupler and Silver Halide Emulsions
Carey-Lea Silver Interlayer
Fast Magenta Layer Containing a Magenta Imaging Coupler, a Magenta DIR Coupler, a Yellow-Colored Magenta Dye-Forming Masking Coupler and a Silver Halide Emulsion
Slow Magenta Layer Containing a Magenta Imaging Coupler, a Magenta DIR Coupler, a Yellow-Colored Magenta Dye-Forming Masking Coupler and Silver Halide Emulsions
Gelatin Interlayer
Fast Cyan Layer Containing:
Imaging Coupler B1 (0.140) + S2 (0.070)
Masking Coupler E5 (0.037)
DIAR Coupler E6 (0.108) + S5 (0.215)
and
IIIa Comparison BARC E1 (0.043) + S4 (0.043) {0.073 mmol/sq m}
or IIIb Comparison BARC E4 (0.053) + S1 (0.106) {0.073 mmol/sq m}
or IIIc Comparison BARC E4 (0.037) + S1 (0.074) {0.051 mmol/sq m}
or IIId Invention BARC C1 (0.044) + S1 (0.088) {0.073 mmol/sq ml}
or IIIe Invention BARC C1 (0.031) + S1 (0.062) {0.051 mmol/sq m}
or IIIf Invention BARC C5 (0.048) + S1 (0.097) {0.073 mmol/sq ml}
or IIIg Invention BARC C5 (0.033) + S1 (0.066) {0.051 mmol/sq m}
Silver Halide Emulsion (1.002 g Ag/sq m)
Slow Cyan Layer Containing:
Imaging Coupler B1 (0.667) + S2 (0.334)
DIAR Coupler E6 (0.059) + S5 (0.118)
and
IIIa Comparison BARC E1 (0.075) + S4 (0.075) {0.129 mmol/sq m}
or IIIb Comparison BARC E4 (0.093) + S1 (0.185) {0.129 mmol/sq m}
or IIIc Comparison BARC E4 (0.064) + S1 (0.129) {0.090 mmol/sq m}
or IIId Invention BARC C1 (0.079) + S1 (0.157) {0.129 mmol/sq m}
or IIIe Invention BARC C1 (0.055) + S1 (0.110) {0.090 mmol/sq m}
or IIIf Invention BARC C5 (0.084) + S1 (0.168) {0.129 mmol/sq m}
or IIIg Invention BARC C5 (0.059) + S1 (0.118) {0.090 mmol/sq m}
Silver Halide Emulsion (0.689 g Ag/sq m)
Silver Halide Emulsion (0.419 g Ag/sq m)
Silver Halide Emulsion (1.205 g Ag/sq m)
Antihalation Layer Containing Cyan (B11), Magenta and Yellow Dummy Dyes, Grey Silver and an Interlayer Scavanger
Cellulose Acetate Support

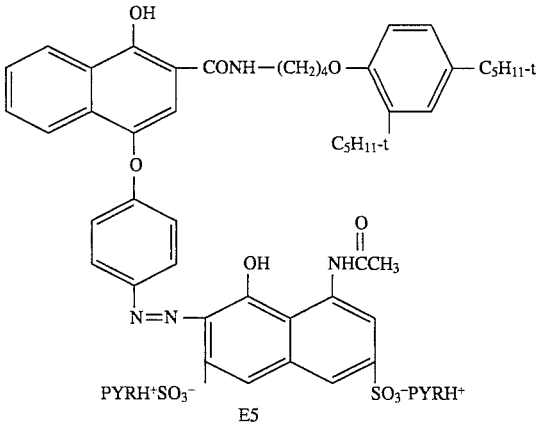

E5

-continued

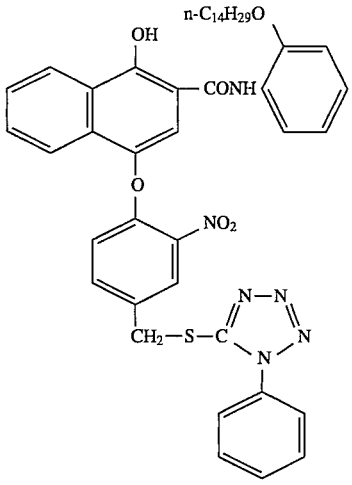

E6

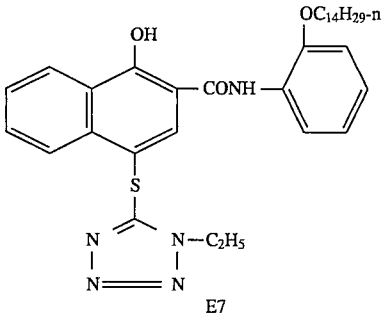

E7

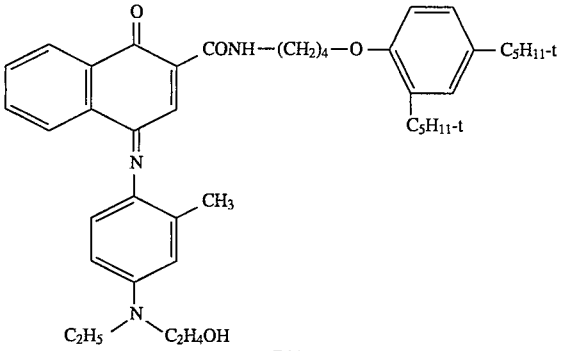

B11

Table III contains gamma data and leuco cyan dye data for multilayer films of structures IIIa-g noted above. As noted previously, one of the functions of a BARC can be to enhance silver developability and thereby increase gamma. BARCs C1 and C5 of this invention produce desirable increases in gamma relative to comparative BARCs E1 and E4 (when coated at an equimolar level). Further, BARC E1 yields a substantially larger loss in red density in seasoned Bleach vs fresh Bleach II compared to the films with BARCs C1 and C5. This is due to the higher level of leuco dye formation for the dye derived from comparative BARC E1 in the seasoned bleach.

As noted above, BARC E4 is inferior since it does not give a suitably large increase in gamma. In addition, as was noted in previous examples, BARC E4 also yields a dye hue that is more bathochromic than desirable.

Only BARCs C1 and C5 of this invention have all of the desired activity, bleach acceleration, dye hue and dye stability features.

TABLE III

| Film | BARC | Relative Molar Level | Relative Red Gamma | [Dr (Bleach B) - Dr (Bleach II)] @ Dr = 1.0 | [Dr (Bleach B) - Dr (Bleach II)] @ Dr = 2.0 |
|---|---|---|---|---|---|
| IIIa | E1 | 1.00 | 1.00 | −0.18 | −0.43 |
| IIIb | E4 | 1.00 | 0.83 | −0.11 | −0.28 |
| IIIc | E4 | 0.70 | 0.76 | −0.09 | −0.24 |
| IIId | C1 | 1.00 | 1.05 | −0.12 | −0.26 |
| IIIe | C1 | 0.70 | 0.96 | −0.12 | −0.27 |
| IIIf | C5 | 1.00 | 1.01 | −0.11 | −0.34 |
| IIIg | C5 | 0.70 | 0.96 | −0.10 | −0.30 |

Example 4

Use of a 2-Phenylcarbamoyl-1-Naphthol BARC of this Invention in a Multilayer Film.

The multilayer films compared in this Example had the following structure:

| Multilayer Film Structure for Example 4 |
|---|
| Overcoat Layer Containing UV Absorbers and Cyan and Magenta Dyes |
| Fast Yellow Layer Containing Yellow Imaging Couplers, a Yellow DIAR Coupler, BARC E1 and Silver Halide Emulsions |
| Slow Yellow Layer Containing Yellow Imaging Couplers, a Yellow DIAR Coupler, BARC E1 and Silver Halide Emulsions |
| Interlayer Containing a Yellow Filter Dye |
| Fast Magenta Layer Containing a Magenta Imaging Coupler, Magenta and Yellow DIRs, a Magenta Masking Coupler and a Silver Halide Emulsion |
| Mid Magenta Layer Containing a Magenta Imaging Coupler, a Magenta Masking Coupler, a Cyan DIAR Coupler and a Silver Halide Emulsion |
| Slow Magenta Layer Containing a Magenta Imaging Coupler, a Magenta Masking Coupler and Silver Halide Emulsions |
| Gelatin Interlayer |
| Fast Cyan Layer Containing: |
| Imaging Coupler B1 (0.172) + S2 (0.086) BARC E1 (0.002) + S4 (0.002) |
| DIR E7 (0.048) + S1 (0.194) DIAR E6 (0.013) + S5 (0.026) |
| Silver Halide Emulsion (1.076 g Ag/sq m) and Masking Coupler E5 (0.048) |
| Mid Cyan Layer Containing: |
| Imaging Coupler B1 (0.226) + S2 (0.113) BARC E1 (0.003) + S4 (0.003) |
| DIR E7 (0.048) + S1 (0.194) DIAR E6 (0.006) + S5 (0.012) |
| Silver Halide Emulsion (0.699 g Ag/sq m) and Masking Coupler E5 (0.022) |
| Slow Cyan Layer Containing: |
| Imaging Coupler B1 (0.538) + S2 (0.269) |
| Silver Halide Emulsion (0.355 g Ag/sq m) |
| Silver Halide Emulsion (0.301 g Ag/sq m) |
| Masking Coupler E5 (0.027) |
| BARC E1 (0.086) Comparison + S4 (0.086) or C2 (0.086) Invention + S4 (0.086) |
| Antihalation Layer Containing Grey Silver and Cyan (B11), Magenta and Yellow Dyes (Same cyan dye as derived from coupler E1) |
| Cellulose Acetate Support |

Film IVa had 0.086 g/sq m of the comparison BARC E1 in the slow cyan layer as in film IIIa above. In film IVb the E1 was replaced with 0.086 g/sq m of the BARC of this invention C2. The films were exposed, processed and analyzed as in the prior Example. As shown in Table IV, the film containing BARC C2 showed a substantial reduction in red density loss in seasoned Bleach B in comparison to the film with BARC E1. In addition the film with BARC C2 showed desirable increases in gamma and red density at upper scale exposures relative to the film with BARC E1. For example, film IVb yields a red density of 1.85 at the same exposure where film IVa has a density of 1.80. The higher activity of BARC C2 allows reduction of the level coated by about 15%.

TABLE IV

| | | [Dr (Bleach B) - Dr (Bleach II)] | |
|---|---|---|---|
| Film | BARC | @ Dr = 1.0 | @ Dr = 1.8 |
| IVa | E1 (comparison) | −0.14 | −0.27 |
| IVb | C2 (invention) | −0.10 | −0.19 |

In the course of determining the couplers of the present invention, it was found that other types of novel two- (or four) equivalent 2-phenylcarbamoyl-1-naphthol image-modifying couplers also exhibit a resistance to leuco cyan dye formation and crystallization at low temperatures. These other image-modifying couplers, which have photographically useful groups other than a bleach accelerator moiety, include timed or untimed, switched or unswitched development inhibitor releasing couplers (DIAR couplers and DIR couplers), and masking couplers.

The DIR and DIAR couplers preferably have the structure:

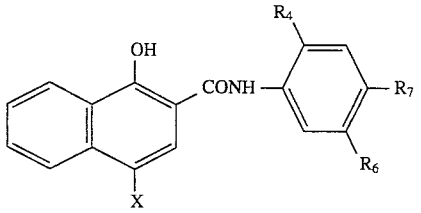

wherein:

X is a timed or untimed development inhibitor moiety;

$R_4$ is selected from an alkoxy group, a phenoxy group and halogen;

$R_6$ is selected from the group consisting of an alkyl group, a phenyl group, an alkoxy group, an alkoxycarbonyl, and a halogen;

$R_7$ is selected from hydrogen, and an alkyl group; and $R_4$, $R_6$, and $R_7$ together contain at least 3 carbon atoms.

The masking couplers preferably have the structure:

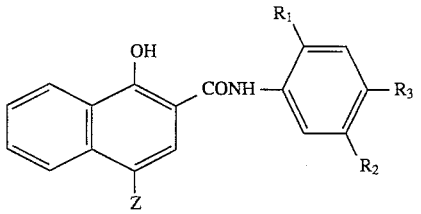

II wherein:

$R_1$ is selected from an alkoxy group, a phenoxy group and halogen;

$R_2$ is selected from the group consisting of an alkyl group, a phenyl group, an alkoxy group, an alkoxycarbonyl group, and a halogen;

$R_3$ is selected from hydrogen, and an alkyl group;

$R_1$, $R_2$, and $R_3$ together contain at least 3 carbon atoms; and

Z is a coupling off group having the formula

—A—B—N=N—D wherein:

A represents a divalent linking group which releases from the coupler upon reaction of the coupler with oxidized developer to cleave Z from the remainder of the coupler;

B is a divalent aromatic group; and

D is an aryl group containing at least one sulfonate or carboxyl group.

In the preferred embodiments of the present invention, any or all of the above-described DIR couplers, DIAR couplers, and masking couplers, are combined with the novel two-equivalent 2-phenylcarbamoyl- 1-naphthol image-modifying couplers of the present invention, and incorporated into a photographic element. Preferably, the same four equivalent parent coupler is utilized as the basis for all the cyan dye forming DIR couplers, DIAR couplers, BARC's, and masking couplers.

The preceding examples are set forth to illustrate specific embodiments of this invention and are not intended to limit the scope of the compositions, materials or methods of the invention. Additional embodiments and advantages within the scope of the claimed invention will be apparent to one skilled in the art.

What is claimed is:

1. A photographic element comprising a support bearing (a) at least one silver halide emulsion and (b) at least one cyan dye-forming 2-phenylcarbamoyl- 1-naphthol image-modifying coupler having the structure

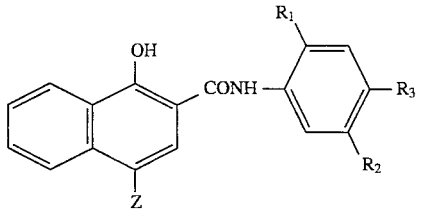

wherein:

$R_1$ is selected from an alkoxy group, a phenoxy group and halogen;

$R_2$ is selected from the group consisting of an alkyl group, a phenyl group, an alkoxy group, a halogen, and an alkoxycarbonyl group; with the proviso that when $R_2$ is a halogen or alkoxycarbonyl group, $R_1$ is selected from an alkoxy or a phenoxy group;

$R_3$ is selected from hydrogen, and an alkyl group;

$R_1$, $R_2$, and $R_3$ together contain at least 3 carbon atoms; and

Z is a bleach accelerator group.

2. A photographic element according to claim 1 wherein $R_1$ is selected from an unsubstituted unbranched alkoxy group, and a substituted alkoxy group having less than 6 carbon atoms.

3. A photographic element according to claim 1 wherein $R_1$, $R_2$, and $R_3$, together contain at least 9 carbon atoms.

4. A photographic element according to claim 3 wherein $R_1$ is an unsubstituted, unbranched alkoxy group, $R_2$ is an unsubstituted alkyl group, and $R_3$ is hydrogen.

5. A photographic element according to claim 4 wherein $R_1$ is an n-dodecyloxy group and $R_2$ is a methyl group.

6. A photographic element according to claim 4 wherein $R_1$ is selected from an n-dodecyloxy group and an n-decyloxy group, and $R_2$ is a secondary butyl group.

7. A photographic element according to claim 3 wherein $R_1$ is an unsubstituted, unbranched alkoxy group, $R_2$ is an alkoxycarbonyl group, and $R_3$ is hydrogen.

8. A photographic element according to claim 7 wherein $R_1$ is an n-octyloxy group and $R_2$ is a 2-ethylhexoxycarbonyl group.

9. A photographic element according to claim 1 wherein $R_2$ is selected from the group consisting of an alkyl group, a phenyl group, an alkoxy group, and a halogen; with the proviso that when $R_2$ is a halogen, $R_1$ is selected from an alkoxy or a phenoxy group.

10. A photographic element according to claim 9 wherein when $R_2$ is an alkoxy group, it is unbranched and unsubstituted.

11. A photographic element according to claim 1 wherein the bleach accelerator group has the structure $$-(\mathrm{TIME})_p-S-L-W$$

wherein:

TIME is a timing or switching group;

p is 0 or 1;

L is a linking group containing from 1 to 8 carbon atoms; and

W is a water solubilizing group.

12. A photographic element according to claim 11 wherein L is selected from substituted or unsubstituted alkylene and alkylene-O-alkylene groups.

13. A photographic element according to claim 12 wherein W is selected from a carboxyl group, a hydroxyl group or an amino group.

14. The photographic element according to claim 11 wherein the bleach accelerator group has the structure:

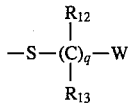

wherein:

q is 1 to 6;

W is a carboxyl group or a hydroxyl group;

and $R_{12}$, $R_{13}$, are individually selected from hydrogen, alkyl groups having 1 to 4 carbon atoms, alkoxy groups having 1 to 4 carbon atoms, and hydroxyl groups; with the proviso that when W is a hydroxyl group, at least one of the $R_{12}$ or $R_{13}$ is a hydroxyl group.

15. The photographic element according to claim 14 wherein q is 2.

16. The photographic element according to claim 11 wherein the bleach accelerator group has the structure:

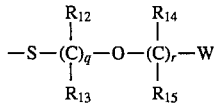

wherein:

q is 1 to 6;

r is 1 to 4;

W is a carboxyl group or a hydroxyl group;

$R_{12}$, $R_{13}$, $R_{14}$ and $R_{15}$ are selected individually from hydrogen, alkyl groups having 1 to 4 carbon atoms, alkoxy groups having 1 to 4 carbon atoms or hydroxyl groups; with the proviso that when W is a hydroxyl group, at least one of the $R_{12}$ through $R_{15}$ groups is a hydroxyl group.

17. The photographic element according to claim 16 wherein q and r are 2.

18. The photographic element according to claim 11 wherein the bleach accelerator group is selected from the group consisting of $$-S-CH_2-CH_2-COOH$$

and $$-S-CH_2-CH_2-O-CH_2-CH_2-COOH$$

19. The photographic element according claim 1 wherein the image modifying coupler is selected from the group consisting of:

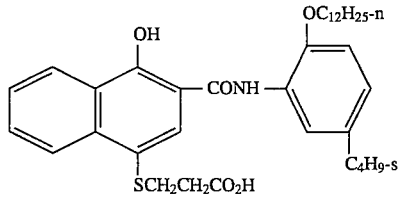

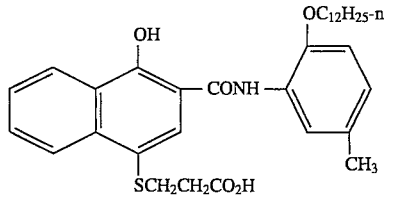

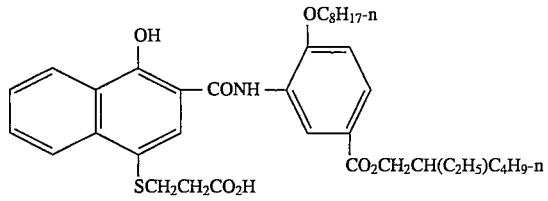

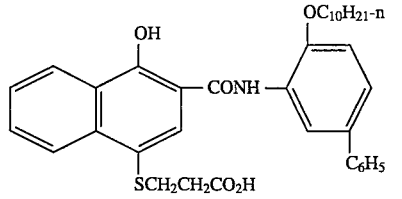

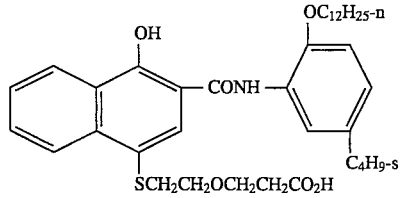

-continued

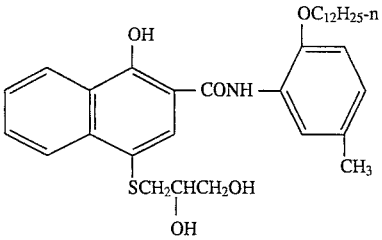

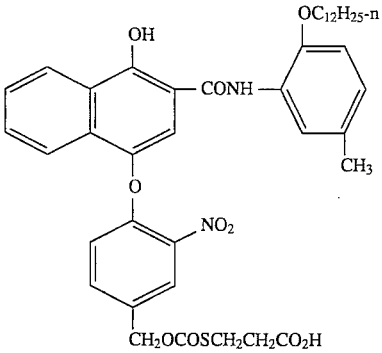

and

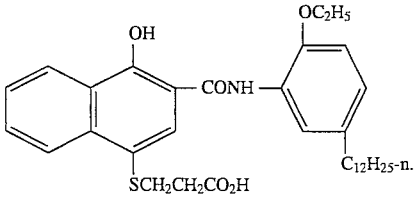

20. A photographic element according to claim 1 further comprising a cyan dye forming 2-phenylureido-5-carbonamidophenol imaging coupler.

21. A photographic element according to claim 1 wherein said image-modifying coupler is present in amounts between about 0.002 and about 0.40 grams per square meter silver.

22. A photographic element according to claim 1 which further comprises at least one cyan dye-forming 2-phenylcarbamoyl-1-naphthol image-modifying coupler having the structure:

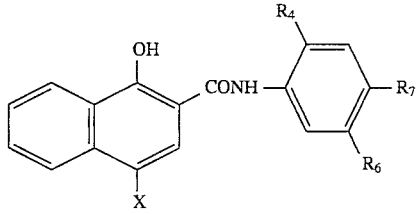

wherein:

X is a timed or untimed development inhibitor moiety;

$R_4$ is selected from an alkoxy group, a phenoxy group and halogen;

$R_6$ is selected from the group consisting of an alkyl group, a phenyl group, an alkoxy group, an alkoxycarbonyl, and a halogen;

$R_7$ is selected from hydrogen, and an alkyl group; and $R_4$, $R_6$, and $R_7$ together contain at least 3 carbon atoms.

* * * * *